US010315456B2

(12) United States Patent
Whigham

(10) Patent No.: US 10,315,456 B2
(45) Date of Patent: Jun. 11, 2019

(54) CHALK STICK HOLDER AND METHOD OF USE

(71) Applicant: Christopher J. Whigham, Lenexa, KS (US)

(72) Inventor: Christopher J. Whigham, Lenexa, KS (US)

( * ) Notice: Subject to any disclaimer, the term of this patent is extended or adjusted under 35 U.S.C. 154(b) by 0 days.

(21) Appl. No.: 15/872,621

(22) Filed: Jan. 16, 2018

(65) Prior Publication Data

US 2018/0201048 A1 Jul. 19, 2018

Related U.S. Application Data

(60) Provisional application No. 62/446,653, filed on Jan. 16, 2017.

(51) Int. Cl.
*B43K 23/016* (2006.01)
*B43K 23/00* (2006.01)

(52) U.S. Cl.
CPC ..... *B43K 23/016* (2013.01); *B43K 23/00* (2013.01)

(58) Field of Classification Search
CPC ..... B43K 23/016; B43K 23/00; B43K 24/02; B43K 24/026; B43K 21/02; B43K 21/027; B43K 21/06; B43K 21/22; B43K 21/16; B43K 21/18; F16L 37/26; F16L 37/252; F16L 19/005; F16L 37/18; F16L 37/088; F16L 37/1225; F16L 27/12
See application file for complete search history.

(56) References Cited

U.S. PATENT DOCUMENTS

| | | | | |
|---|---|---|---|---|
| 5,931,592 | A * | 8/1999 | Timberlake | B43K 23/016 401/82 |
| 6,241,410 | B1 * | 6/2001 | Hager | B43K 23/016 401/89 |
| 6,474,696 | B1 * | 11/2002 | Canale | A47L 9/244 285/7 |
| 6,793,429 | B2 * | 9/2004 | Arrison | B43K 23/016 401/117 |
| 9,004,794 | B2 | 4/2015 | Whigham | |
| 9,764,458 | B1 * | 9/2017 | Resh | B25G 3/18 |
| 2010/0272495 | A1 * | 10/2010 | Srn nsk | B43K 23/016 401/88 |

* cited by examiner

*Primary Examiner* — David J Walczak
(74) *Attorney, Agent, or Firm* — Law Office of Mark Brown, LLC; Christopher M. DeBacker

(57) ABSTRACT

A chalk stick holder device having a handle portion, a hollow central tube portion, and a gripper portion. The three portions can be joined together to form a long-reaching chalk stick holder for drawing on surfaces while the user remains standing. The gripper portion includes a spring-action receiver for receiving a chalk stick and securing the chalk stick within the gripper end using a locking tooth. Upon pressing the locking tooth, the receiver releases the chalk stick, which can then be replaced with another color of chalk stick stored in the hollow central tube portion.

9 Claims, 7 Drawing Sheets

CHALK STICK HOLDER AND METHOD OF USE

CROSS-REFERENCE TO RELATED APPLICATION

This application claims priority in U.S. Provisional Patent Application No. 62/446,653 Filed Jan. 16, 2017, which is incorporated herein by reference.

BACKGROUND OF THE INVENTION

1. Field of the Invention

The present invention relates generally to a chalk stick holder and method for use thereof, and more specifically to a multi-part chalk stick holder tool with handle, extension rod and chalk holder, and gripping end.

2. Description of the Related Art

Children enjoy drawing on surfaces, such as sidewalks and driveways, with colored chalk sticks. The problem with these sticks are that they can get lost and damaged when not in use, and can leave a chalk residue on the child's hands during use. Further, often the child will want to play with their parent or another adult while using the chalk, but often older adults have problems kneeling or bending to reach the coloring surface such as the sidewalk or driveway.

Heretofore there has not been available a system or method for a chalk stick holder with the advantages and features of the present invention.

BRIEF SUMMARY OF THE INVENTION

The present invention generally provides a chalk stick holder device having a handle portion, a hollow central tube portion, and a gripper portion. The three portions can be joined together to form a long-reaching chalk stick holder for drawing on surfaces while the user remains standing. The gripper portion includes a spring-action receiver for receiving a chalk stick and securing the chalk stick within the gripper end using a locking tooth. Upon pressing the locking tooth, the receiver releases the chalk stick, which can then be replaced with another color of chalk stick stored in the hollow central tube portion.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

Figure 1:
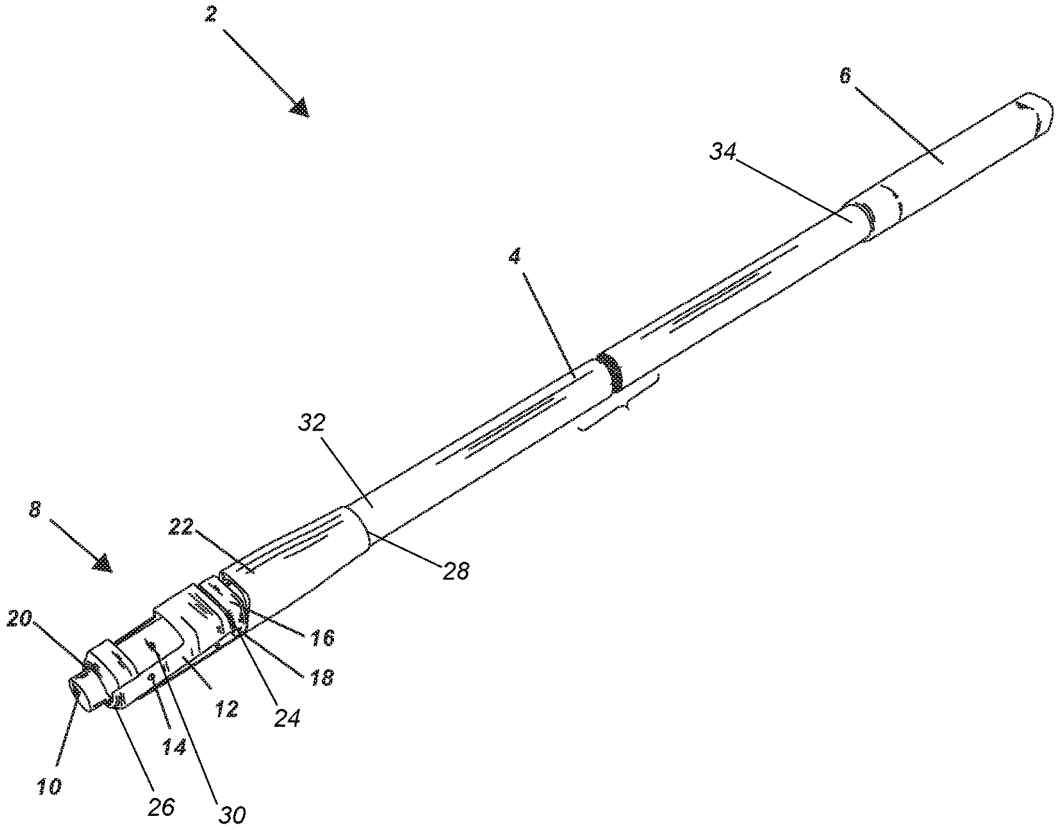
FIG. 1 is a three-dimensional isometric view of a preferred embodiment of the present invention.
Figure 2:
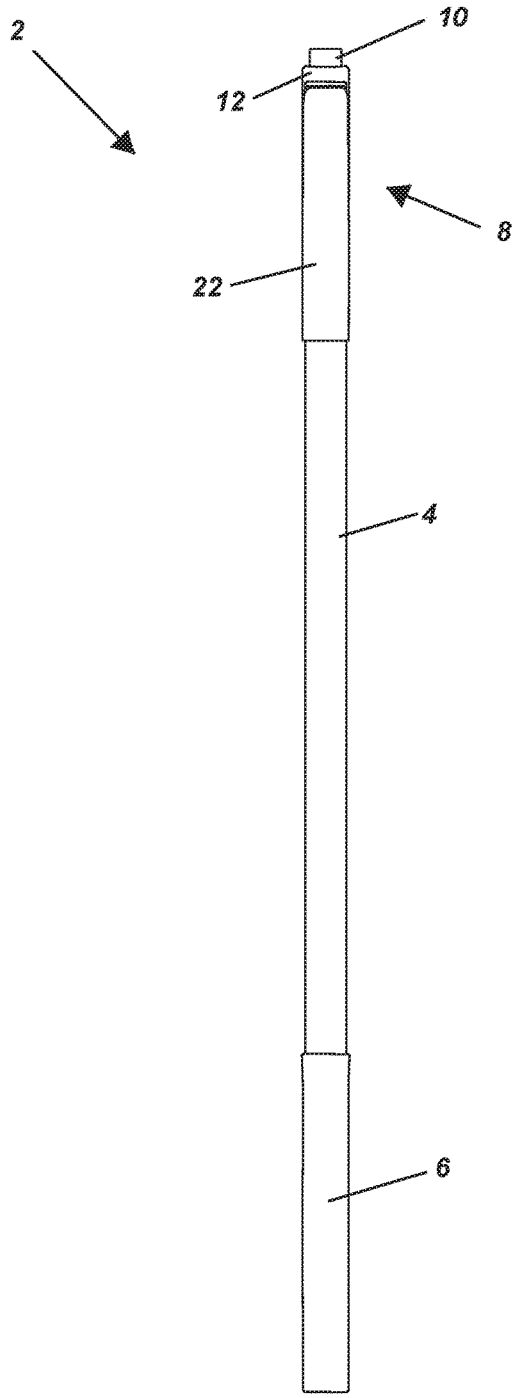
FIG. 2 is a top plan view thereof.

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Chalk Stick Holder 2

As shown in the figures, a preferred embodiment of the present invention chalk stick holder 2 generally includes three parts: a handle end piece 6 for gripping, a hollow central tube 4 for storing unused chalks sticks (not shown), and a gripper end 8 for gripping one chalk stick 10. The hollow central tube 4 joins the handle end 6 and the gripper end 8 to form one long, single device as shown in the figures; however, the three pieces can be separated at will at any time.

The gripper end 8 includes a claw-like receiver 22 for allowing a chalk stick to be inserted into an opening 20 in that end, and then kept in place by the receiver using a spring action clip 12 which pivots about a spring hinge 14. The release lever 16 has several teeth 24 for securing the receiver clip 12 in place about the chalk stick 10 or to relieve the chalk stick from the receiver. The front end of the spring action clip 12 clamps against the chalk stick 10 and is held there by the release leaver 16, allowing the chalk stick 10 to be extended as it is worn down. The release lever 16 is pinned to the receiver 22 with a pin 18.

The gripper end 8 could be used as a stand-alone drawing device by itself to prevent chalk dust from staining the hands of the user, or could be used on the end of the hollow central tube and the handle end as a long-reach means of using the chalk stick. This would prevent adults or others who have physical ailments, such as back or knee problems, from bending or kneeling on the ground to draw using the chalk stick.

The receiver 22 has a front (proximal) end 26 and a rear (distal) end 28, as well as a hollow space 30 for holding the chalk stick 10. The hollow central tube 4 has a proximal end 32 which is received within the receiver 22 distal end 28. The hollow central tube 4 has a distal end 34 which is connected to the handle end piece 6.

Figure 3:
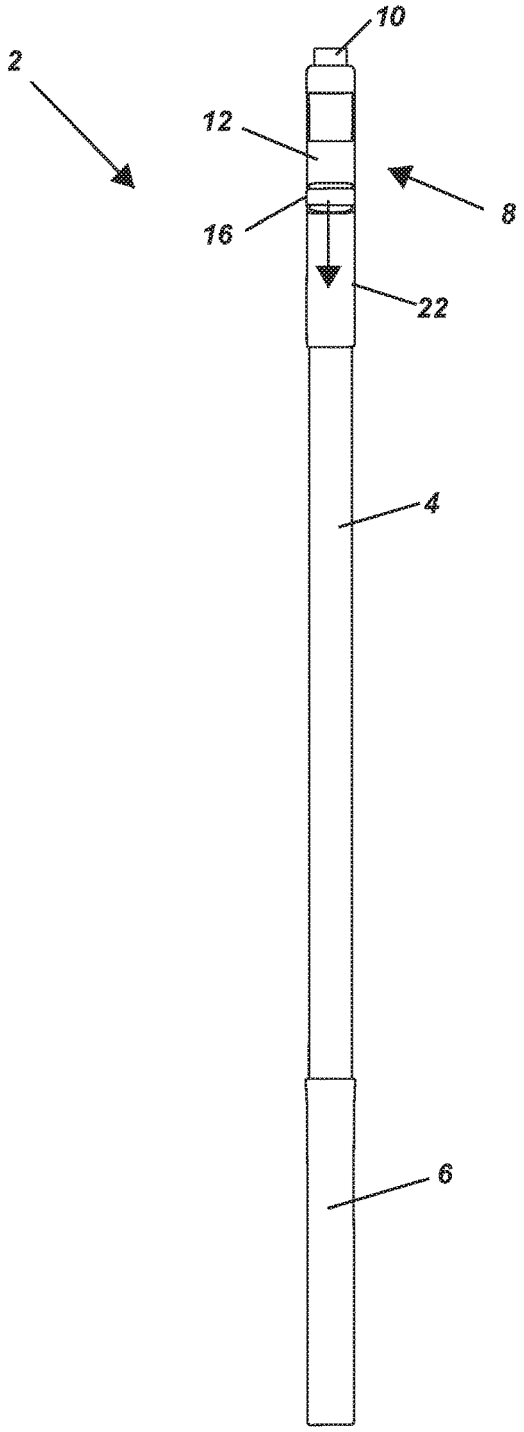
FIG. 3 is a bottom plan view thereof.
Figure 4:
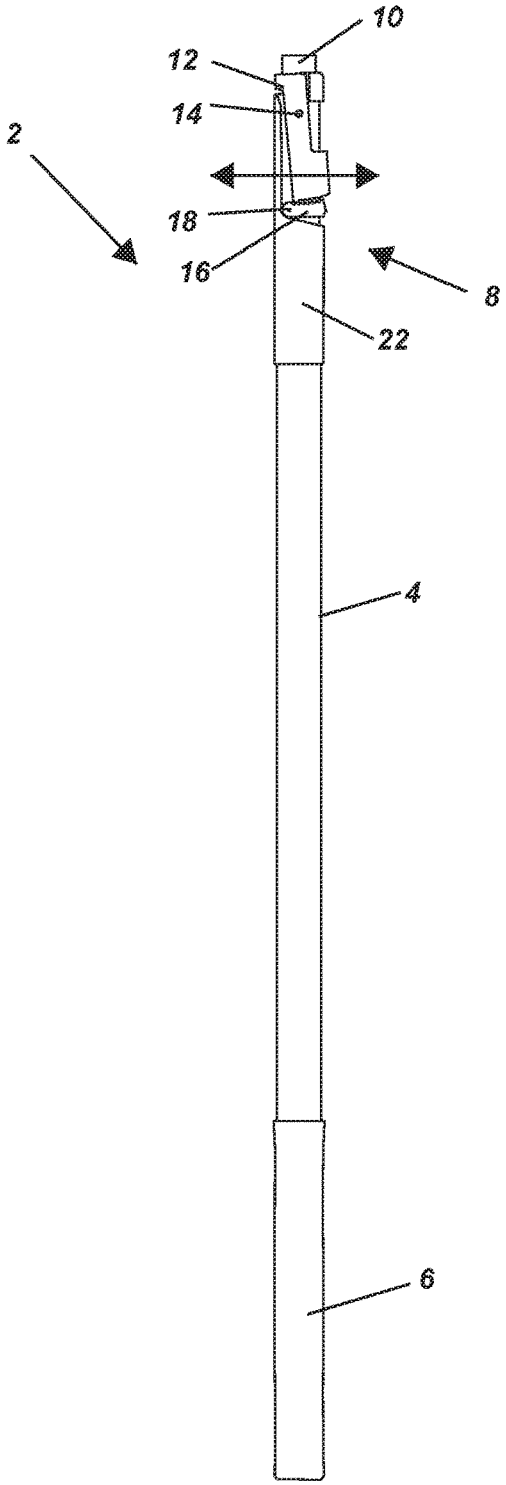
FIG. 4 is a left side elevational view thereof.
Figure 5:
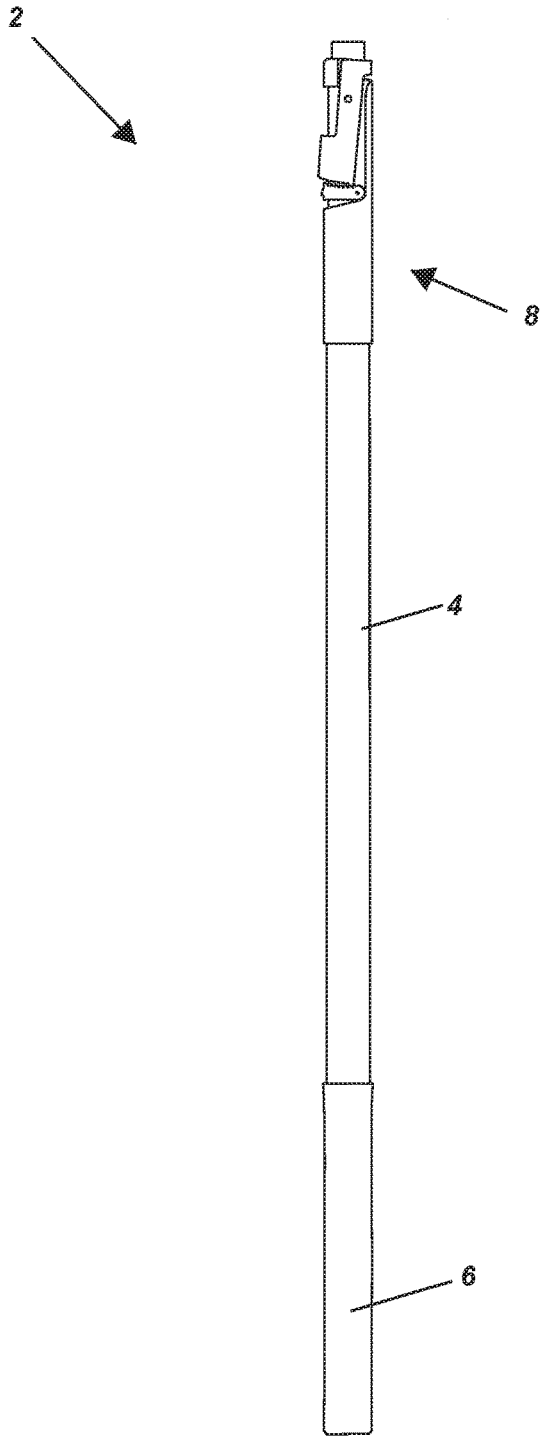
FIG. 5 is a right side elevational view thereof.
Figure 6:
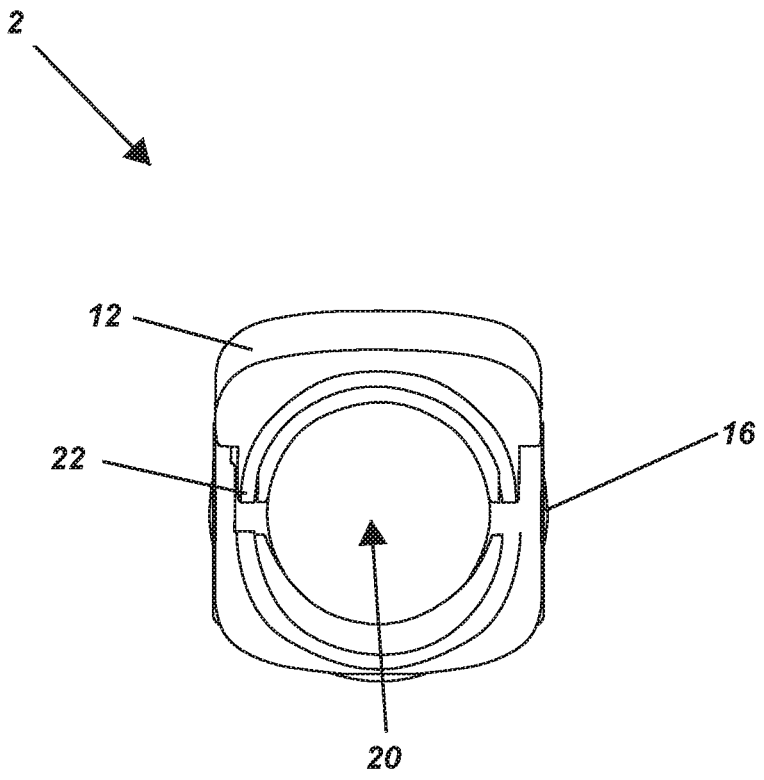
FIG. 6 is a front elevational view thereof.
Figure 7:
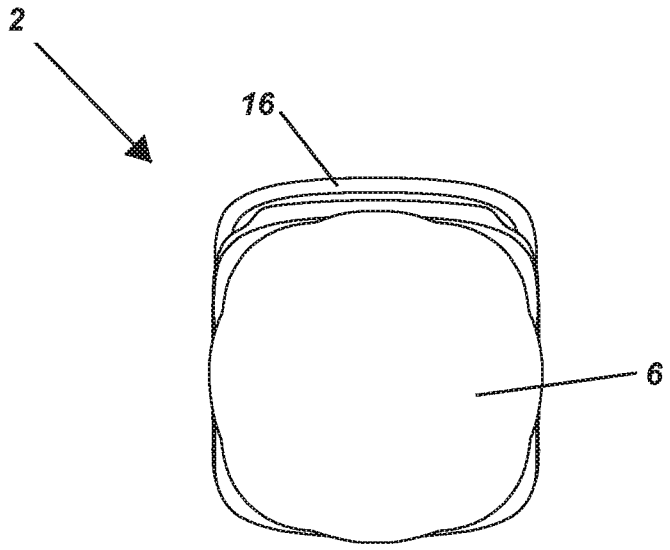
FIG. 7 is a rear elevational view thereof.

As shown in FIG. 4, the spring action receiver clip 12 pivots up and down about the spring hinge 14, which connects the clip to the receiver 22. The user can manipulate this by pulling down on or simply gripping the receiver clip 12, which clamps the front end of the receiver clip 12 against the chalk stick 10, securing it in place. As shown in FIG. 3, the release lever 16 can be manually pulled toward the distal end 28 of the receiver 22. This allows the user to clamp down onto the receiver clip 12, thereby locking the chalk stick 10 in place about the front opening 20 of the receiver 22. The release lever 16 then catches the receiver clip 12 using its teeth 24. When the user later pulls the release lever 16 away from the receiver clip 12 and toward the distal end of the receiver, the spring hinge 14 automatically rotates the receiver clip 12 about itself such that it releases the chalk stick 10. This maneuver could be performed with a single hand.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A chalk stick holder device comprising:

a receiver having an opening in a proximal end of said receiver, said opening configured for receiving a chalk stick;

said receiver having a hollow body for holding said chalk stick within;

a spring clip affixed to said receiver via a spring hinge, said spring clip having a front end configured to lock said chalk stick within said receiver, and wherein said spring clip further configured to release said chalk stick from within said receiver;

a release lever comprising a plurality of teeth, said release lever configured to lock said spring clip into said engaged position by receiving said spring clip within one of said plurality of teeth;

said release lever further configured to be drawn toward a distal end of said receiver, thereby allowing said spring clip to release said chalk stick; and said release lever affixed to said receiver via a pin hinge.

2. The chalk stick holder device of claim 1, further comprising:

a hollow central tube having a proximal end and a distal end;

said proximal end of said hollow tube body removable engaging said distal end of said receiver; and said hollow tube body configured for extending the reach of the chalk stick holder device.

3. The chalk stick holder device of claim 2, wherein said hollow central tube is configured to receive and store at least one additional chalk stick.

4. The chalk stick holder device of claim 2, further comprising:

a handle element affixed to said distal end of said hollow tube body; and said handle element providing a grippable surface.

5. A chalk stick holder device comprising:

a receiver having an opening in a proximal end of said receiver, said opening configured for receiving a chalk stick;

said receiver having a hollow body for holding said chalk stick within;

a spring clip affixed to said receiver via a spring hinge, said spring clip having a front end configured to lock said chalk stick within said receiver, and wherein said spring clip further configured to release said chalk stick from within said receiver;

a release lever comprising a plurality of teeth, said release lever configured to lock said spring clip into said engaged position by receiving said spring clip within one of said plurality of teeth;

said release lever further configured to be drawn toward a distal end of said receiver, thereby allowing said spring clip to release said chalk stick;

said release lever affixed to said receiver via a pin hinge;

a hollow tube body having a proximal end and a distal end;

said proximal end of said hollow tube body removable engaging said distal end of said receiver;

said hollow tube body configured for extending the reach of the chalk stick holder device;

said hollow tube body is configured to receive and store at least one additional chalk stick;

a handle element affixed to said distal end of said hollow tube body; and said handle element providing a grippable surface.

6. A method of using a chalk stick holder, the method comprising the steps:

inserting a chalk stick into an opening within a proximal end of a receiver;

depressing a spring clip element, said spring clip element affixed to said receiver via a spring hinge, thereby holding said chalk stick in place;

simultaneously engaging said spring clip element with a release lever comprising a plurality of teeth, wherein one of said plurality of teeth engage said spring clip element;

sliding said release lever toward a distal end of said receiver, thereby disengaging said spring clip element with said release lever;

releasing said chalk stick from said spring clip element by automatically moving said spring clip element away from said chalk stick via said spring hinge;

and sliding said chalk stick within said receiver.

7. The method of claim 6, further comprising the steps:

engaging a hollow central tube with said distal end of said receiver; and deploying at least one additional chalk stick within said hollow central tube.

8. The method of claim 7, further comprising the steps:

removing said at least one additional chalk stick from said hollow central tube; and inserting said additional chalk stick within said receiver opening.

9. The method of claim 7, wherein said hollow central tube terminates into a handle element.

* * * * *